US012569040B1

(12) United States Patent
Zhan

(10) Patent No.: US 12,569,040 B1
(45) Date of Patent: Mar. 10, 2026

(54) ADJUSTABLE-LENGTH WATCH STRAP

(71) Applicant: Minghua Zhan, Shenzhen (CN)

(72) Inventor: Minghua Zhan, Shenzhen (CN)

( * ) Notice: Subject to any disclaimer, the term of this patent is extended or adjusted under 35 U.S.C. 154(b) by 0 days.

(21) Appl. No.: 19/265,148

(22) Filed: Jul. 10, 2025

(51) Int. Cl.
*A44C 5/08* (2006.01)

(52) U.S. Cl.
CPC ..... *A44C 5/08* (2013.01)

(58) Field of Classification Search
CPC ..... G04B 37/1486; A44C 5/107; A44C 5/105; F16G 15/04
USPC ..... 59/82, 85
See application file for complete search history.

(56) References Cited

U.S. PATENT DOCUMENTS 6,488,404 B2 * 12/2002 Zurcher ..... A44C 5/107 63/4
6,494,030 B2 * 12/2002 Cazard ..... A44C 5/107 63/4
7,303,330 B2 * 12/2007 Hartzband ..... A44C 5/107 368/282

FOREIGN PATENT DOCUMENTS

CH 713709 A1 * 10/2018 ..... A44C 5/105
WO WO-2018043783 A1 * 3/2018 ..... G04G 19/00

* cited by examiner

*Primary Examiner* — Jack W Lavinder
(74) *Attorney, Agent, or Firm* — ScienBiziP, P.C.

(57) ABSTRACT

The present disclosure provides an adjustable-length watch strap including a plurality of strap units connected to each other. Each of the plurality of strap units comprising a middle link, a first side link, a second side link, a first connecting member and a lock assembly, the first connecting member comprises a pin and a first elastic member, during transition from the first state to the second state, the first elastic member elastically relaxes thereby moving the pin along the first direction to disengage the first connecting member from the first side link, the middle link of the adjacent strap unit and the second side link, so as to separate two adjacent strap units.

20 Claims, 11 Drawing Sheets

ADJUSTABLE-LENGTH WATCH STRAP

TECHNICAL FIELD

The disclosure relates to the technical field of watch straps, particularly to an adjustable-length watch strap.

BACKGROUND

Traditional watch straps typically include middle links and side links, with the side links symmetrically positioned on both sides of the middle links. Conventional metal watch straps mostly adopt pin-based connections for assembling the middle links and the side links. However, adjusting a length of the adjustable-length watch strap usually requires specialized tools to disassemble the middle links and the side links, this process to disassemble the middle links and the side links is both tedious and time-consuming. This makes it difficult for ordinary users to complete the adjustment independently, leading to inconvenience in the use of traditional watch straps.

BRIEF DESCRIPTION OF DRAWINGS

Implementations of the present disclosure will now be described, by way of embodiment, with reference to the attached figures.

DETAILED DESCRIPTION

Figure 1:
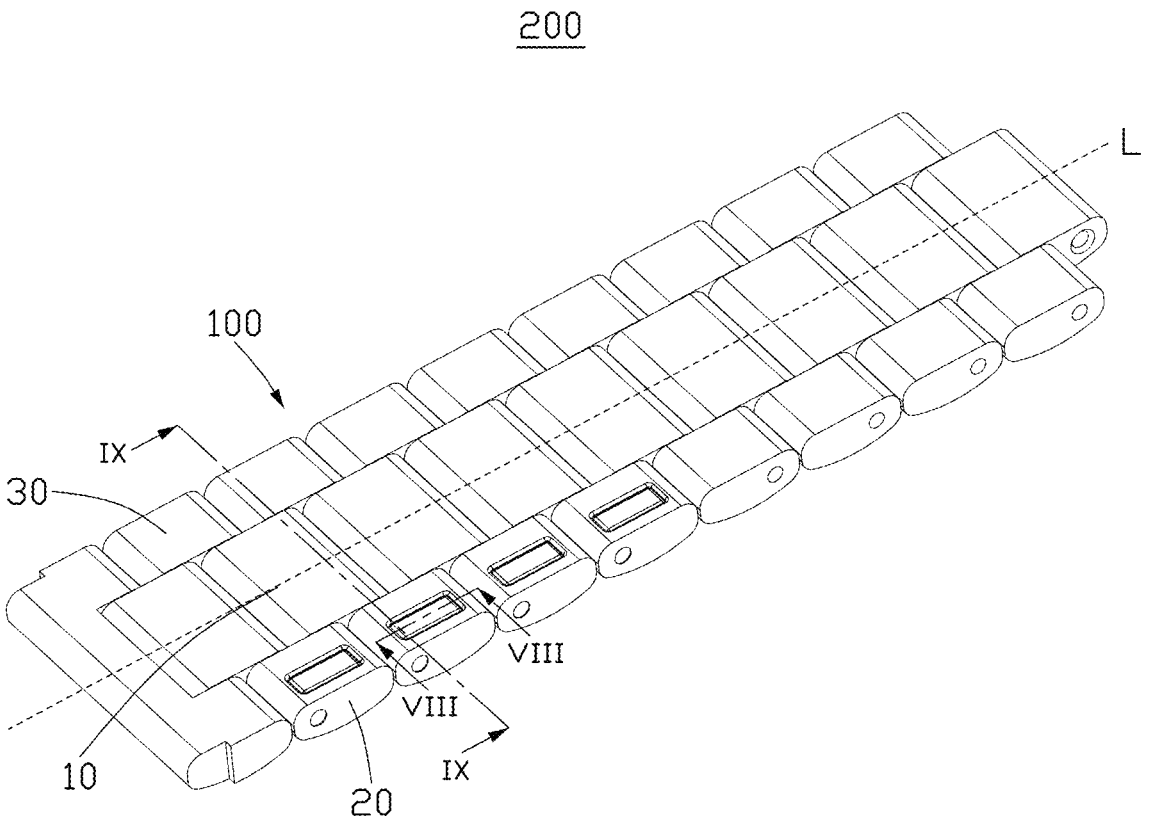
FIG. 1 is a partial three-dimensional structural diagram of a adjustable-length watch strap.

It will be appreciated that for simplicity and clarity of illustration, where appropriate, reference numerals have been repeated among the different figures to indicate corresponding or analogous elements. In addition, numerous specific details are set forth in order to provide a thorough understanding of the exemplary embodiments described herein. However, it will be understood by those of ordinary skill in the art that the exemplary embodiments described herein may be practiced without these specific details. In other instances, methods, procedures, and components have not been described in detail so as not to obscure the related relevant feature being described. Also, the description is not to be considered as limiting the scope of the exemplary embodiments described herein. The drawings are not necessarily to scale and the proportions of certain parts may be exaggerated to better illustrate details and features of the present disclosure.

Figure 2:
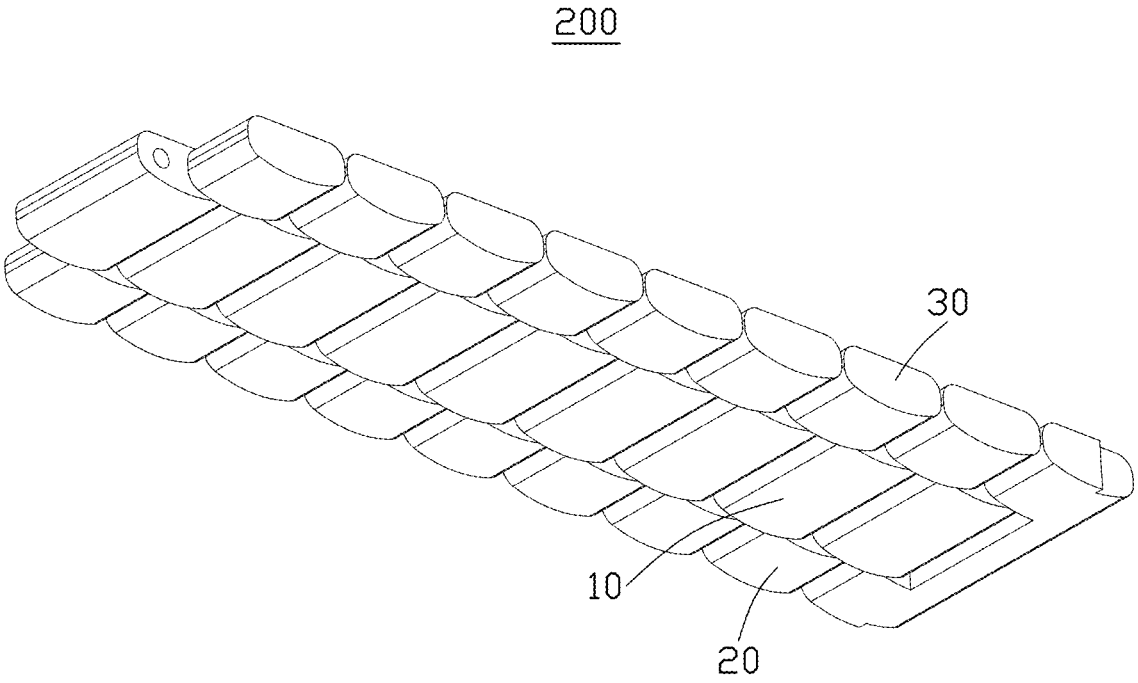
FIG. 2 is a three-dimensional structural diagram of the adjustable-length watch strap shown in FIG. 1, viewed from another viewing angle.
Figure 3:
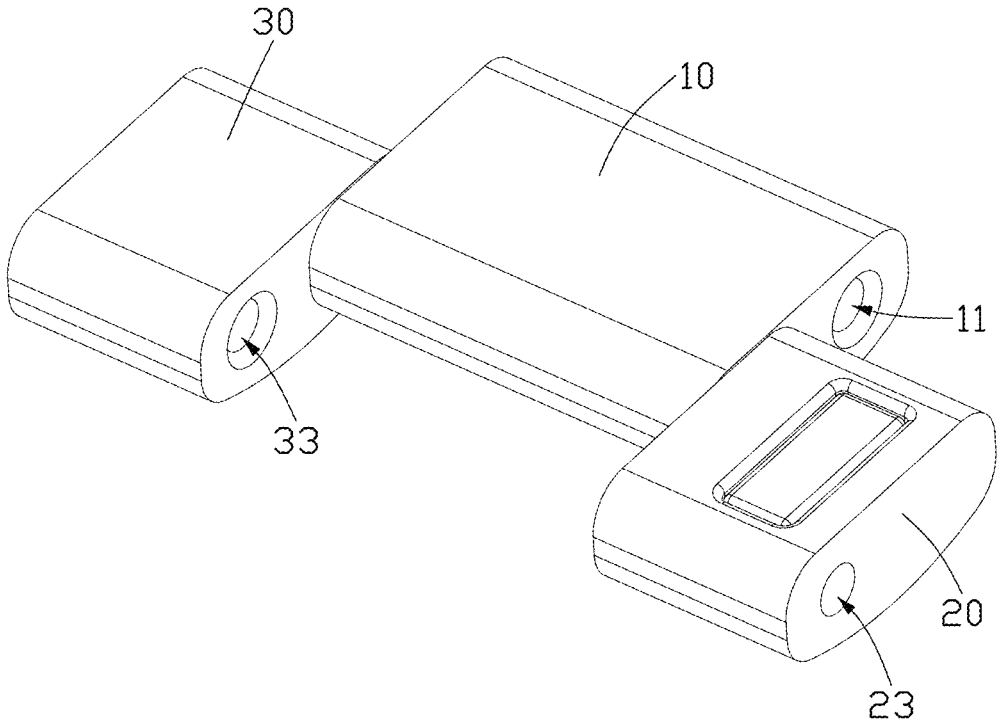
FIG. 3 is a three-dimensional structural diagram of a part of a strap unit of the adjustable-length watch strap shown in FIG. 1, viewed from another viewing angle.
Figure 4:
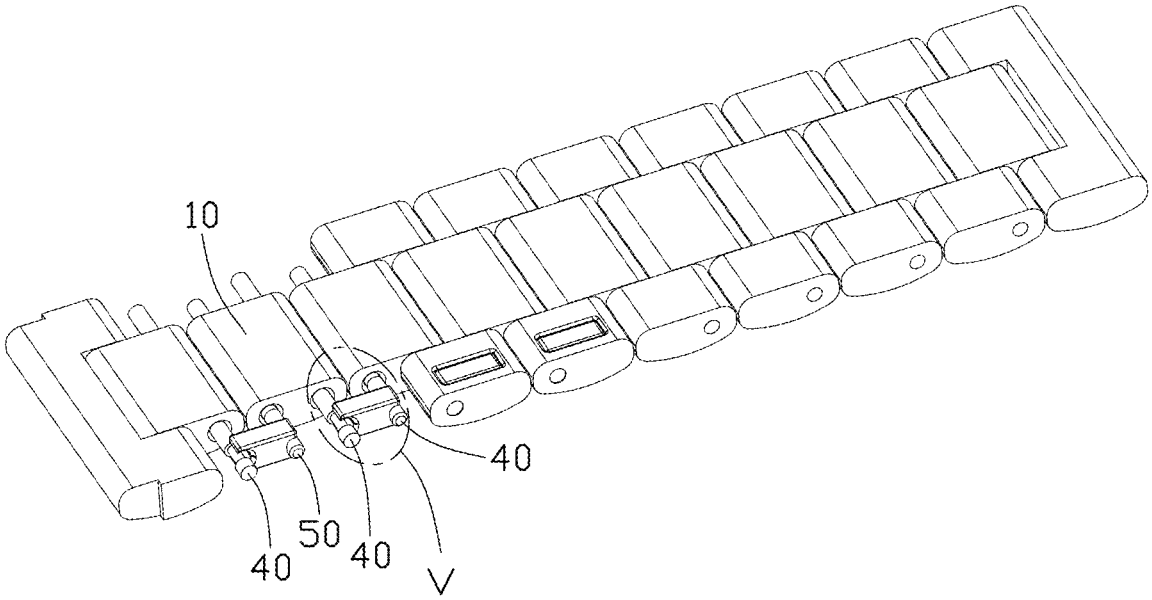
FIG. 4 is a three-dimensional structural diagram of the adjustable-length watch strap shown in FIG. 1, some specific side links are removed.
Figure 5:
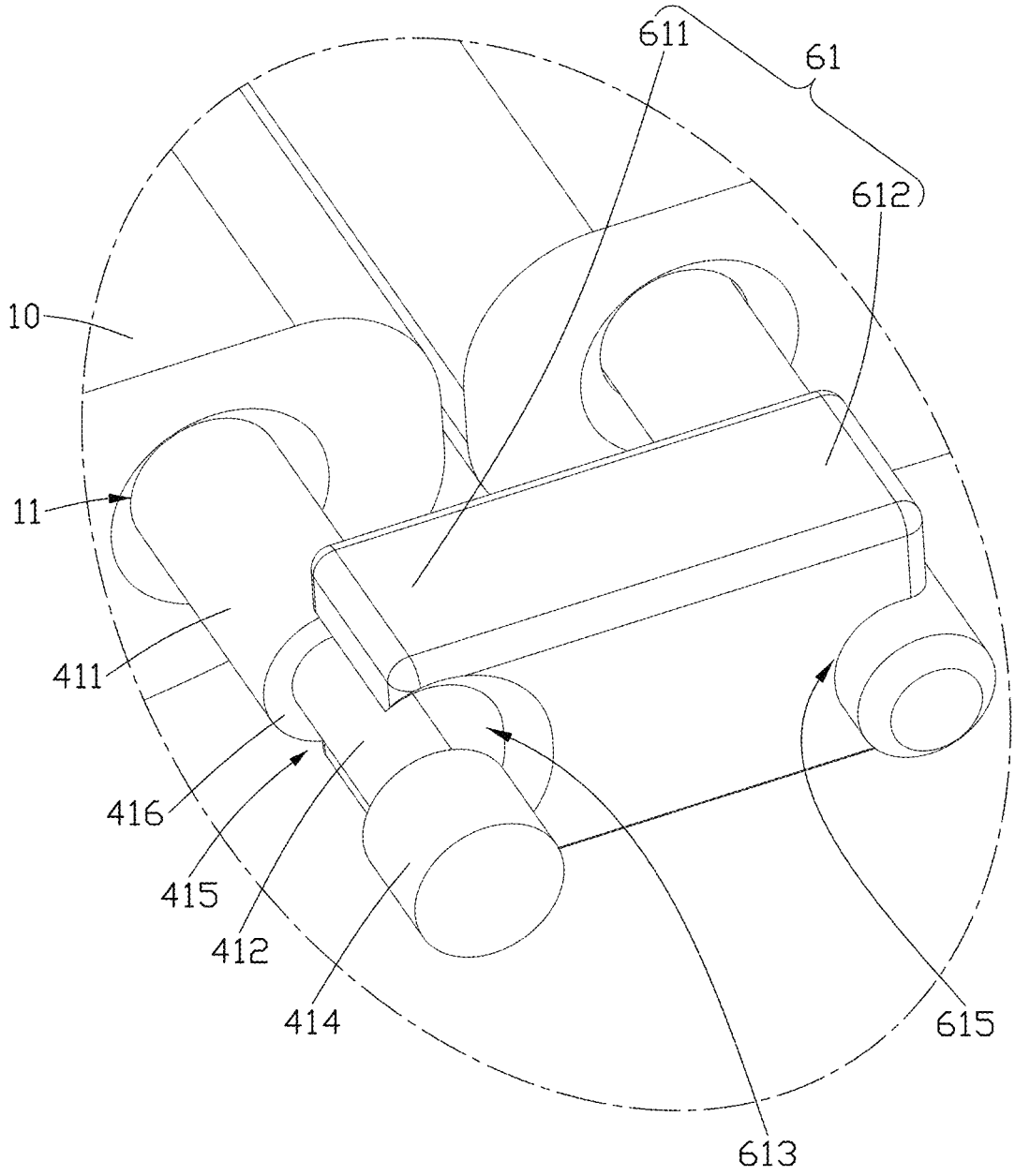
FIG. 5 is a partially enlarged view of region V as shown in FIG. 3.
Figure 6:
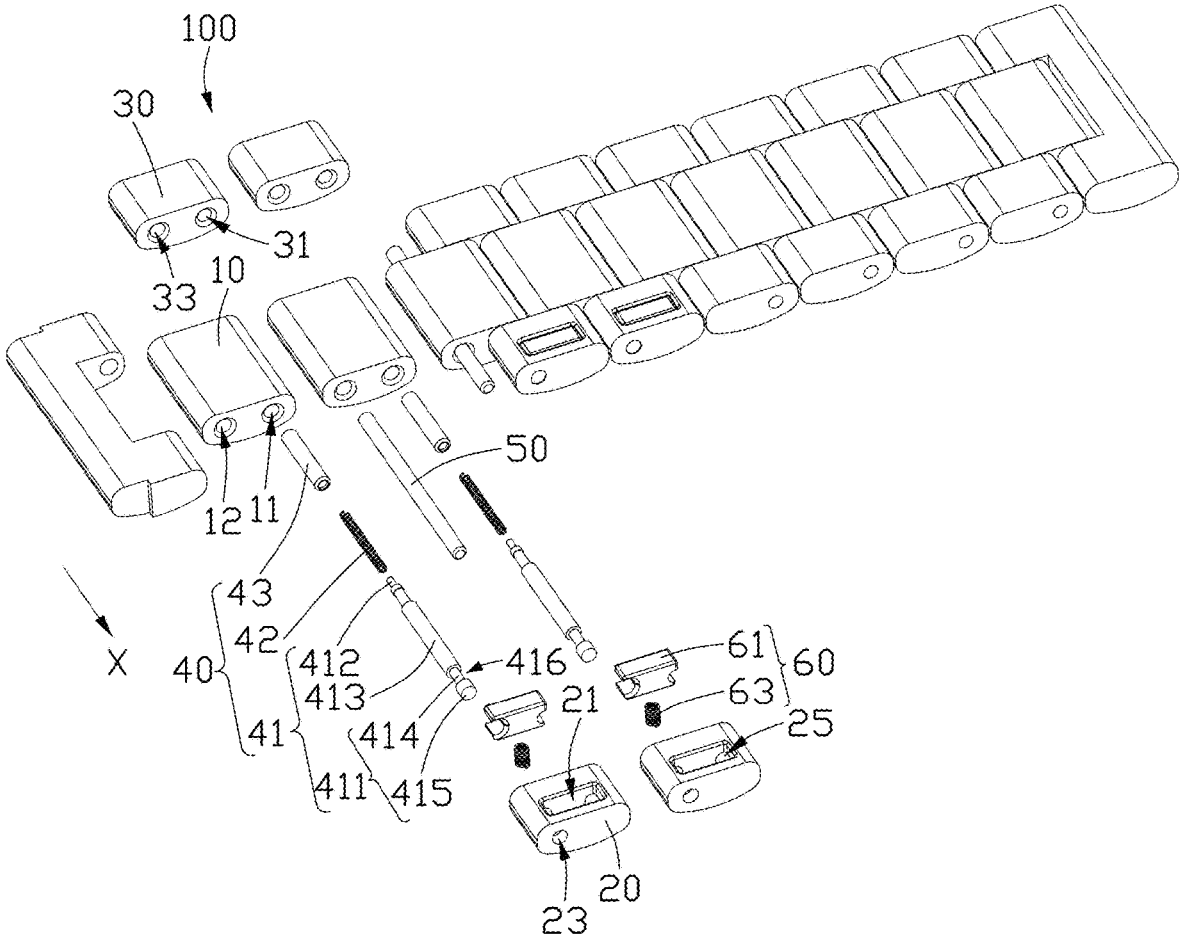
FIG. 6 is a partly exploded view of the adjustable-length watch strap as shown in FIG. 1.
Figure 7:
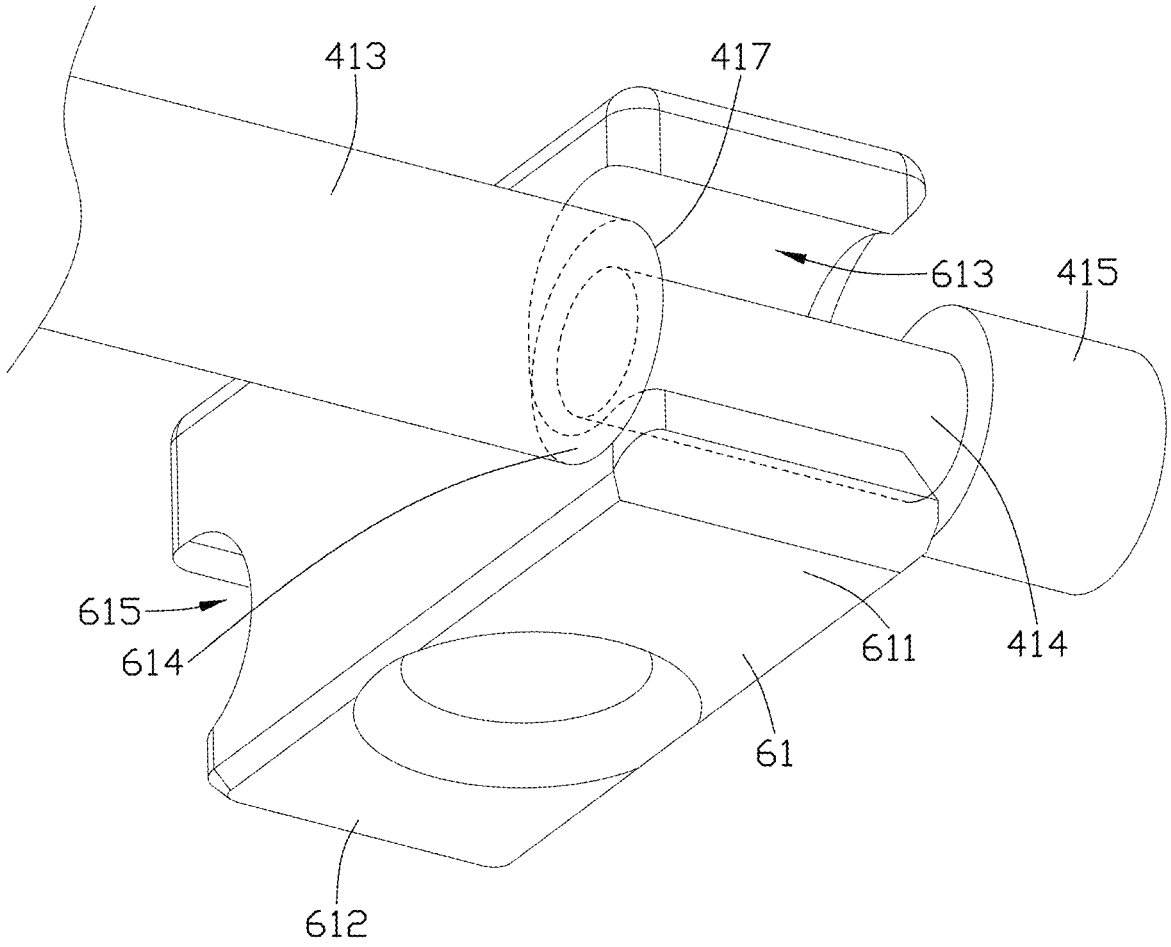
FIG. 7 is a partial three-dimensional structural diagram of the adjustable-length watch strap as shown in FIG. 4, viewed from another viewing angle.

Referring to FIG. 1 to FIG. 2, the present disclosure provides an adjustable-length watch strap 200. The adjustable-length watch strap 200 includes a plurality of strap units 100. A length of the adjustable-length watch strap 200 is adjustable by increasing or decreasing a number of the strap units 100. When it is wanted to increase the length of the adjustable-length watch strap 200, a number of strap units 100 are needed to add in the adjustable-length watch strap 200; when it is wanted to reduce the length of the adjustable-length watch strap 200, a number of strap units 100 is removed from the adjustable-length watch strap 200.

Referring to FIG. 3 to FIG. 11, each strap unit 100 includes a middle link 10, a first side link 20, a second side link 30, a first connecting member 40, a second connecting member 50, and a lock assembly 60. The adjustable-length watch strap 200 is switchable between a first state in which the length of the adjustable-length watch strap 200 is non-adjustable and a second state in which the length of the adjustable-length watch strap 200 is adjustable. Two adjacent strap units 100 are detachably connected by the first connecting member 40, and when the adjustable-length watch strap 200 is in the first state, the first connecting member 40 is fixed relative to the middle link 10. When the adjustable-length watch strap 200 is in the second state, the first connecting member 40 is detachable from the first side link 20, the middle link 10 of an adjacent strap unit 100, and the second side link 30, such that the two adjacent strap units 100 can be separated by removing the first connecting member 40. In this way, This design allows users to add or remove one or more strap units 100 from the adjustable-length watch strap 200 by themselves according to their requirements.

The middle links 10 of the plurality of strap units 100 are sequentially aligned along a line L, which is parallel to a length direction of the adjustable-length watch strap 200. The first side links 20 and the second side links 30 are located at opposite two sides of the middle links 10 and offset relative to the middle links 10. The middle link 10 of each strap unit 100 includes a first through hole 11 and a second through hole 12, which are spaced apart and opposite to each other, both of which penetrate the middle link 10 along a direction X which is perpendicular to the line L, the direction X may correspond to a width direction of the adjustable-length watch strap 200.

The first side link 20 is disposed at one of the opposite two sides of the middle link 10 and offset relative to the corresponding middle link 10. In this embodiment, a receiving groove 21 is defined on a top side of the first side link 20 to receive the lock assembly 60. In this embodiment, the top side refers to a side that contacts skin of user when the watch is worn on the user.

Furthermore, the first side link 20 has a first fitting hole 23 and a first connecting hole 25, both of which extend along the direction X and penetrate through a lateral side of the first side link 20 which is adjacent to the middle link 10. In this embodiment, the first fitting hole 23 and the first connecting hole 25 are arranged in parallel and in air communicated with the receiving groove 21. In this embodiment, the first fitting hole 23 is a through hole.

Figure 9:
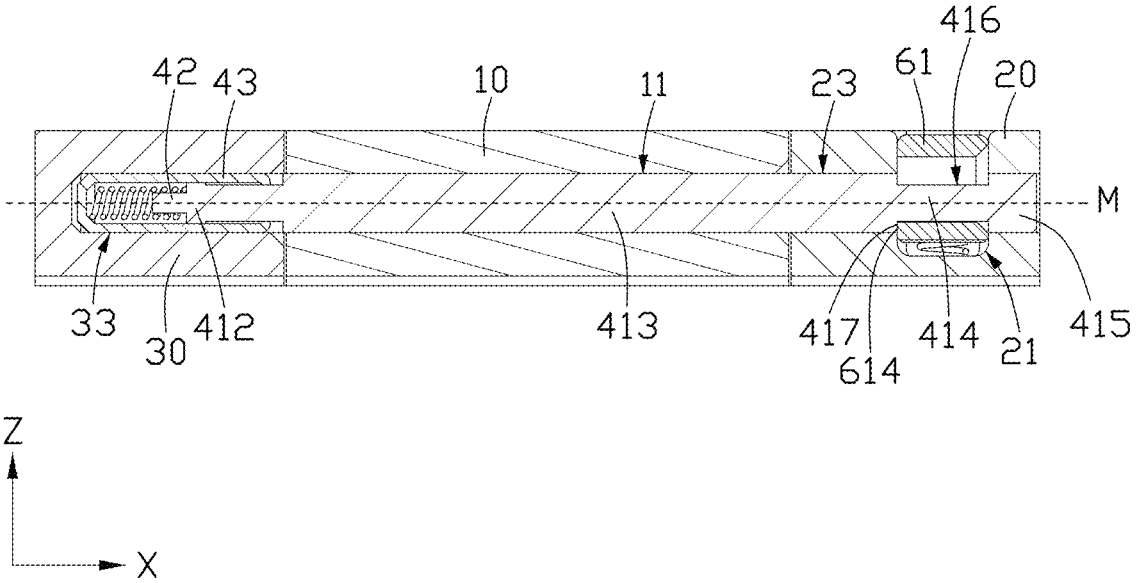
FIG. 9 is a cross-sectional view of the adjustable-length watch strap in the first state as shown in FIG. 1, taken along line IX-IX.

Referring to FIG. 9, in a thickness direction Z of the adjustable-length watch strap 200, a bottom of the first fitting hole 23 is closer to a second central line M in the thickness direction Z of the adjustable-length watch strap 200 than a bottom of the receiving groove 21, a distance from the second central line M to the upper surface of the adjustable-length watch strap 200 equals a distance from the second central line M to a lower surface of the adjustable-length watch strap 200.

The second side link 30 is disposed at another side of the two opposite sides of the middle link 10 and offset relative to the corresponding middle link 10.

In addition, the second side link 30 includes a second fitting hole 31 and a second connecting hole 33, both of which extend along the width direction X of the adjustable-length watch strap 200 and penetrate through a lateral side of the second side link 30 which is adjacent to the middle link 10. The second fitting hole 31 is aligned with the second through hole 12 and the first connecting hole 25, and the second connecting member 50 passes through the second through hole 12, and two ends of the second connecting member 50 are respectively fixedly received in the second fitting hole 31 and the first connecting hole 25. When the adjustable-length watch strap 200 is in the second state and needed to be installed, the second connecting hole 33 is aligned with the first through hole 11 of the adjacent middle link 10 and the first fitting hole 23, so that the first connecting member 40 is allowed to pass through the first fitting hole 23, the first through hole 11 of the adjacent middle link 10, and the second connecting hole 33 in sequence, thereby connecting the two adjacent strap units 100.

The first connecting member 40 is configured for connecting the two adjacent strap units 100. The first connecting member 40 includes a pin 41 which has a first end 411 and a second end 412 arranged at opposite ends of the pin 41. The first end 411 is detachably inserted into the first side link 20, and the second end 412 is inserted into the second side link 30 after the pin 40 passes through the middle link 10 of the adjacent strap unit 100.

Specifically, the pin 41 further includes a middle portion 413 arranged between the first end 411 and the second end 412 and received in the middle link 10 of the adjacent strap unit 100 when the adjustable-length watch strap 200 is in the first state. The first end 411 comprises a first portion 414 connected to the middle portion 413 and a second portion 415 connected to the first portion 414. In this embodiment, a diameter of the first portion 414 is smaller than the diameter of each of the middle portion 413 and the second portion 414, so as to define a recess 416 between the middle portion 413 and the second portion 414. An abutting surface 417 is formed on an end surface of the middle portion 413 which faces the recess 416.

Specifically, the first connecting member 40 further includes a first elastic member 42 connected to the second end 412 of the pin 41, and a sleeve 43 sleeved on the second end 412, and the first elastic member 41 is received in the sleeve 43. In this embodiment, a diameter of the second end 412 is smaller than the diameter of the middle portion 413, so as to the sleeve 43 is capable of being sleeved on the second end 412 and received in the second connecting hole 33 of the second side link 30.

The first elastic member 42 is sleeved around the second end 412 of the pin 41 and configured to apply an elastic force to the pin 41 along the direction X of the adjustable-length watch strap 200, so as to the pin 41 is capable of moving along the direction X of the adjustable-length watch strap 200 under the elastic force of the first elastic member 42. When the adjustable-length watch strap 200 is in the first state, the first elastic member 42 is elastically compressed, and when the adjustable-length watch strap 200 switches from the first state to the second state, the first end 411 of the pin 41 is at least partially exposed from the first side link 20, such that the two adjacent strap units 100 can be separated by removing the pin 41. The first elastic member 42 can be a spring, an elastic washer, or any other components with elastic functions, capable of applying an appropriate elastic force to ensure stability of the first connecting member 40 during use.

In this embodiment, the first elastic member 42 is sleeved on the second end 412. Both of the second end 412 of the pin 41 and the first elastic member 42 are received in the sleeve 43. The sleeve 43 can prevent a directly contact between the first elastic member 42 and an inner wall of the second connecting hole 33 and also ensure the stability and reliability of the first connecting member 40.

The second connecting member 50 is configured for connecting the first side link 20, the middle link 10, and the second side link 30. In this embodiment, the second connecting member 50 is a cylindrical connecting member, and an outer diameter of the second connecting member 50 matches inner diameters of the second fitting hole 31, the second through hole 12 and the first connecting hole 25, such that interference fits are formed between both ends of the second connecting member 50 and the second fitting hole 31 and the first connecting hole 25, so that the first side link 20 and the second side link 30 are non-detachably disposed on opposite sides of the middle link 10. In this embodiment, the middle link 10 is rotatably sleeved on the second connecting member 50.

The lock assembly 60 is configured to enable or disenable the movement of the first connecting member 40, so as to switch the adjustable-length watch strap 200 between the first state and the second state. In the first state, a majority portion of the first connecting member 40 is inserted in the middle link 10 with an end of the first connecting member 40 being locked in the first side link 20. In the second state, the first end 411 of the first connecting member 40 is unlocked from the first side link 20 and the first connecting member 40 can be removed from the middle link 10, the first side link 20 and the second side link 30.

The locking assembly 60 includes a lock 61, and a second elastic member 63.

The lock 61 is movably received in the receiving groove 21 of the first side link 20. The second elastic member 63 is sandwiched between a bottom of the receiving groove 21 and the lock 61 for applying a pulling force onto the lock 61.

Furthermore, the lock 61 includes a left portion 611 and a right portion 612 symmetrical with the left portion 612. The left portion 611 includes a first groove 613 configured for the first connecting member 40 to pass through. The right portion 612 is rotatably connected to the second connecting member 50 and provided with a second groove 615 for allowing the second connecting member 50 to pass through, such that the lock 61 is rotatably sleeved on the second connecting member 50. When the lock 61 is depressed by an external force, the lock 61 moves downwardly from an initial position to a pressed position. In the initial position, the first portion 414 of the first connecting member 40 is received in the first groove 613, and the abutting surface 417 abuts against at least part of a side wall 614 of the pressing portion 61 facing the middle link 10. when the external force is removed from the lock 61, the lock 61 moves upwardly by the pulling force and engaging with the first portion 414, so as to lock the first end 411 of the pin 41 in the first groove 613.

Figure 11:
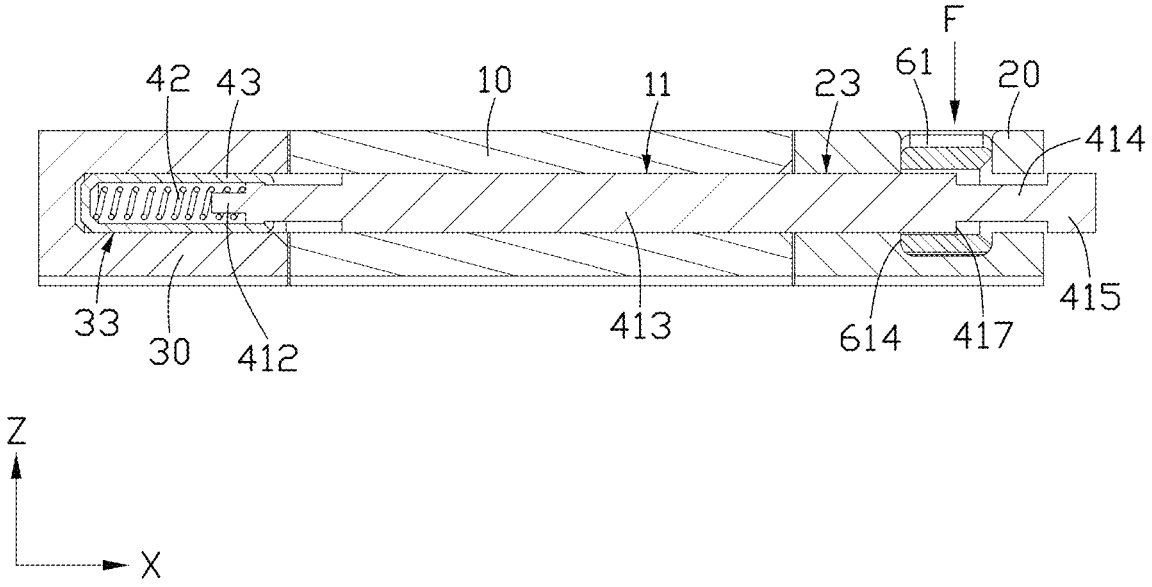
FIG. 11 is a cross-sectional view of the adjustable-length watch strap in the second state as shown in FIG. 1, taken along line IX-IX.

A bottom of the lock 61 is provided with a cavity 617. One end of the second elastic member 63 contacts the first side link 20, and the other end of the second elastic member 63 is received in the cavity 617 of the lock 61. The second elastic member 63 is configured for applying a reset force (the pulling force) to push the lock 61 to a locking position. Referring to FIG. 11, when the lock 61 is pressed and provides a pressing force F, the second elastic member 63 is compressed. Referring to FIG. 9, after releasing the lock 61, the second elastic member 63 returns and pushes the lock 61. In this embodiment, the second elastic member 63 is a spring which can provide a stable and lasting elastic recovery force. In other embodiment, the second elastic member 63 can be a rubber part, or other materials with elastic recovery functions.

Figure 8:
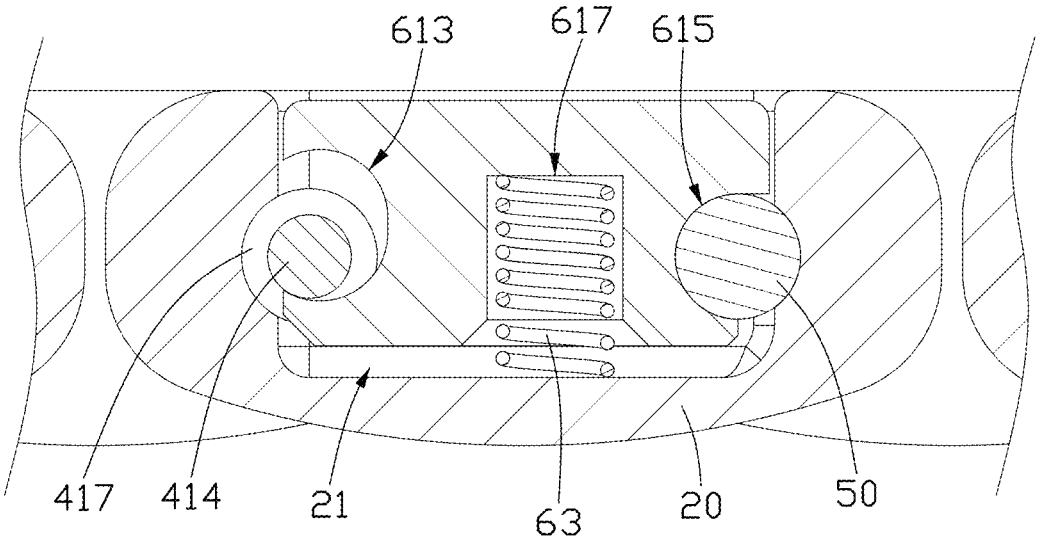
FIG. 8 is a cross-sectional view of the adjustable-length watch strap in a first state as shown in FIG. 1, taken along line VIII-VIII.

Referring to FIG. 8 and FIG. 9, when the adjustable-length watch strap 200 in the first state, the lock 61 in the initial position, a majority portion of the first connecting member 40 is inserted in the middle link 10 with the end of the first connecting member 40 being locked in the first side link 20, so as to prevent the two adjacent strap units 100 from separating.

Figure 10:
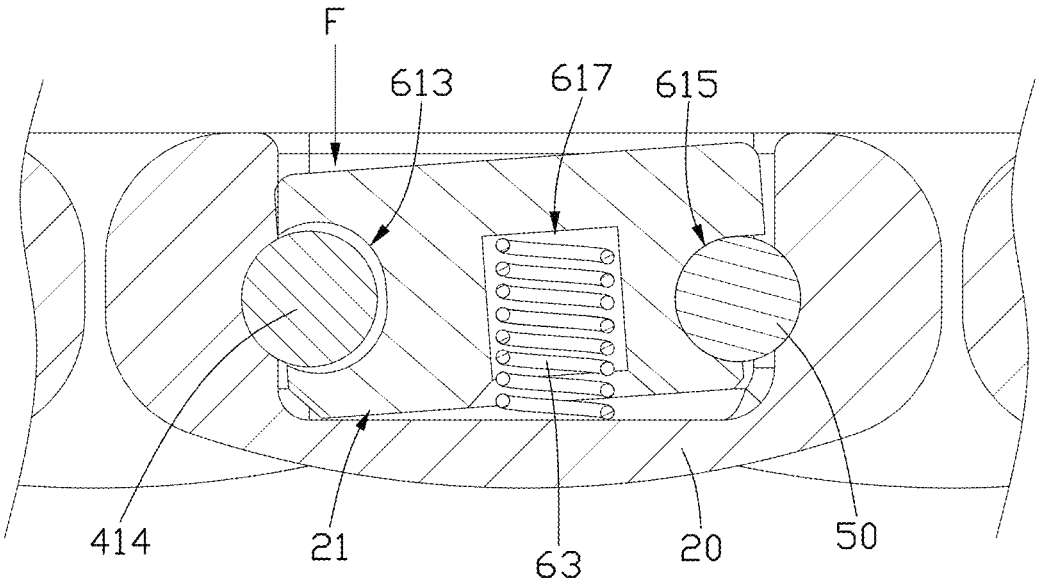
FIG. 10 is a cross-sectional view of the adjustable-length watch strap in a second state as shown in FIG. 1, taken along line VIII-VIII.

Referring to FIG. 10 and FIG. 11, when the length of the adjustable-length watch strap 200 is needed to be adjusted, press the top surface of the lock 61, that is, apply the pressing force F to the top surface of the lock 61, the first end 411 of the first connecting member 40 is exposed from the first side link 20 and can be removed from the adjustable-length watch strap 200, thus allowing disassembling the strap units 100. In this way, it becomes possible to choose to increase or decrease the number of the strap units 100.

When connecting two strap units 100, the first connecting member 40 is inserted sequentially through the first fitting hole 23, the first through hole 11 of the adjacent middle link 10, and the second connecting hole 33, the first connecting member 40 is then pushed in a direction from the first side link 20 to the second side link 30 until the abutting surface 417 abuts at least part of the side wall 614 of the lock 61.

Through the rational design of the structures of the first connecting member 40 and the lock 61, the adjustable-length watch strap 200 can be disassembled, assembled, and adjusted without tools. The operation is simple, facilitating users to adjust the length of the adjustable-length watch strap 200 by themselves and enhancing the user experience.

The present application, through the innovative design of the strap unit 100 and the first connecting member 40, realizes the function of easily adjusting the length of the adjustable-length watch strap 200 without tools, greatly improving the convenience for users and the simplicity of operation.

What is claimed is:

1. An adjustable-length watch strap switchable between a first state in which a length of the adjustable-length watch strap is non-adjustable and a second state in which the length of the adjustable-length watch strap is adjustable, the adjustable-length watch strap comprising:

a plurality of strap units connected to each other, each of the plurality of strap units comprising:

a middle link comprising a first side and a second side opposite to the first side;

a first side link disposed on the first side of the middle link and offset relative to the middle link and comprising a receiving groove defined at a surface of the first side link;

a second side link disposed on the second side of the middle link, and offset relative to the middle link;

a first connecting member configured to detachably connect the first side link, a middle link of an adjacent strap unit of the plurality of strap units, and the second side link, and the first connecting member detachably passing through the first side link, the middle link of the adjacent strap unit, and the second side link in sequence; and a second connecting member arranged parallel to the first connecting member, and connecting the first side link, the middle link, and the second side link, wherein the first side link and the second side link are non-detachably disposed on opposite ends of the second connecting member, respectively; and an locking assembly arranged in the receiving groove of the first side link and configured to enable or disenable a movement of the first connecting member, so as to control the adjustable-length watch strap to be switched between the first state and the second state, wherein the first connecting member comprises a pin and a first elastic member, the pin has a first end and a second end arranged at opposite ends of the pin, the first end is received in the first side link and the second end is received in the second side link when the adjustable-length watch strap is in the first state, the first elastic member is disposed at the second end of the pin and configured to elastically deformed against the pin along a first direction from the second end to the first end of the pin when the adjustable-length watch strap is in the first state, wherein during transition from the first state to the second state, the first elastic member elastically relaxes thereby moving the pin along the first direction to disengage the first connecting member from the first side link, the middle link of the adjacent strap unit and the second side link, so as to separate two adjacent strap units.

2. The adjustable-length watch strap according to claim 1, wherein in the first state, a majority portion of the first connecting member is inserted in the middle link with the first end of the pin locked in the first side link, and the first elastic member is elastically compressed, in the second state, the first end of the pin is unlocked from the first side link and the first connecting member is removable from the second side link, the middle link, and the first side link.

3. The adjustable-length watch strap according to claim 1, wherein the locking assembly comprises a lock movably received in the receiving groove of the first side link, the lock is movable from a free position to a pressed position when the lock is depressed by an external force, in the pressed position, the first end of the pin is unlocked from the first side link, the first connecting member is detachable from the middle link, when the external force is removed from the lock, the lock moves upward to return to the free position.

4. The adjustable-length watch strap according to claim 3, wherein the first end of the pin defines a recess with an abutting surface on an end face facing the recess, an end wall of the lock faces the middle link and abuts the abutting surface of the pin when the adjustable-length watch strap is in the first state, thereby restricting the movement of the first connecting member.

5. The adjustable-length watch strap according to claim 3, wherein the lock comprises a first portion and a second portion symmetrical with the first portion, the first portion comprises a first groove configured for the first connecting member to pass through, and the second portion is fixedly connected to the second connecting member and comprises a second groove configured for the second connecting member to pass through.

6. The adjustable-length watch strap according to claim 5, wherein a size of the first groove is larger than a size of the second groove.

7. The adjustable-length watch strap according to claim 3, wherein a bottom of the lock is provided with a cavity, the locking assembly further comprises a second elastic member received in the cavity and configured for applying a reset force to push the lock to the free position.

8. The adjustable-length watch strap according to claim 1, wherein the first connecting member comprises a sleeve sleeved on the second end of the pin, and the first elastic member is received in the sleeve.

9. The adjustable-length watch strap according to claim 1, wherein the middle link comprises a first through hole and a second through hole, which are spaced apart and opposite to each other, the first side link comprises a first fitting hole and a first connecting hole penetrating through a lateral side of the first side link which is adjacent to the middle link, the second side link comprises a second fitting hole and a second connecting hole penetrating through a lateral side of the second side link which is adjacent to the middle link, the second connecting hole is aligned with the first through hole of the middle link of the adjacent strap unit and the first fitting hole, and the first connecting member passes through the first fitting hole, the first through hole of the middle link of the adjacent strap unit, and the second connecting hole in sequence, the second fitting hole is aligned with the second through hole and the first connecting hole, and the second connecting member passes through the second through hole, and two ends of the second connecting member are respectively and fixedly received in the second fitting hole and the first connecting hole.

10. An adjustable-length watch strap switchable between a first state in which a length of the adjustable-length watch strap is non-adjustable and a second state in which the length of the adjustable-length watch strap is adjustable, and comprising:

a plurality of strap units connected to each other, each of the plurality of strap units comprising a middle link, a first side link, a second side link, a first connecting member and a lock assembly, wherein the first side link and the second side link are non-detachably disposed on opposite sides of the middle link, respectively, and are offset relative to the middle link, wherein the first connecting member detachably connects each two adjacent strap units of the plurality of strap units, and the first connecting member comprises a pin having a first end and a second end opposite to the first end, and a first elastic member connected to the second end of the pin and configured to apply an elastic force to the pin along a width direction of the adjustable-length watch strap, so that the pin is capable of moving along the width direction of the adjustable-length watch strap under the elastic force of the first elastic member, when the adjustable-length watch strap is in the first state, a majority portion of the pin is inserted in a middle link of an adjacent strap unit with the first end of the first connecting member being locked in the first side link by the lock assembly; when the adjustable-length watch strap is in the second state, the lock assembly is unlocked, and the first end of the pin is at least partially exposed from the first side link, such that two adjacent strap units can be separated by removing the pin, wherein the adjustable-length watch strap further comprises a second connecting member arranged parallel to the first connecting member, and connecting the first side link, the middle link, and the second side link.

11. The adjustable-length watch strap according to claim 10, wherein the lock assembly is movably arranged in the first side link and comprises a lock configured to lock the first end of the pin when the adjustable-length watch strap is in the first state, the lock is movable from an initial position to a pressed position when the lock is depressed by an external force, in the pressed position, the first end of the pin is unlocked from the first side link, the first connecting member is detachable from the middle link, when the external force is removed from the lock, the lock moves upward to return to the free position.

12. The adjustable-length watch strap according to claim 11, wherein the first end of the pin defines a recess with an abutting surface on an end face facing the recess, an end wall of the lock faces the middle link and is configured to abut the abutting surface of the pin when the adjustable-length watch strap is in the first state.

13. The adjustable-length watch strap according to claim 11, wherein the first side link comprises a receiving groove defined at a surface of the first side link and configured to receive the lock assembly, the lock comprises a first portion comprising a first groove configured for the first connecting member to pass through.

14. The adjustable-length watch strap according to claim 11, wherein a bottom of the lock is provided with a cavity, the locking assembly further comprises a second elastic member received in the cavity and configured for applying a reset force to push the lock to the free position.

15. The adjustable-length watch strap according to claim 10, wherein the first connecting member comprises a sleeve sleeved on the second end of the pin, and the first elastic member received in the sleeve.

16. The adjustable-length watch strap according to claim 10, wherein the middle link comprises a first through hole and a second through hole, which are spaced apart and opposite to each other, the first side link comprises a first fitting hole and a first connecting hole penetrating through a lateral side of the first side link which is adjacent to the middle link, the second side link comprises a second fitting hole and a second connecting hole penetrating through a lateral side of the second side link which is adjacent to the middle link, the second connecting hole is aligned with the first through hole of the adjacent middle link and the first fitting hole, and the first connecting member passes through the first fitting hole, the first through hole of the adjacent middle link, and the second connecting hole in sequence, the second fitting hole is aligned with the second through hole and the first connecting hole, and the second connecting member passes through the second through hole, and two ends of the second connecting member are respectively and fixedly received in the second fitting hole and the first connecting hole.

17. An adjustable-length watch strap switchable between a first state in which a length of the adjustable-length watch strap is non-adjustable and a second state in which the length of the adjustable-length watch strap is adjustable, and comprising:

a plurality of strap units connected to each other, each of the plurality of strap units comprising a middle link, a first side link, a second side link, a first rod, an elastic member, a second rod and a lock assembly, wherein the first side link and the second side link are disposed on opposite sides of the middle link, respectively, and are offset relative to the middle link, wherein the first rod detachably connects each two adjacent strap units of the plurality of strap units, and the first rod comprises a first end and a second end opposite to the first end, the elastic member is connected to the second end of the first rod and elastically deformable against the first rod in a width direction of the adjustable-length watch strap, the first rod is movable in the width direction of the adjustable-length watch strap in response to the elastic member elastically deformed, wherein the second rod is arranged parallel to the first rod, and configured for fixedly connecting the first side link, the middle link, and the second side link, in a case that the adjustable-length watch strap is in the first state, a majority portion of the first rod is inserted in a middle link of an adjacent strap unit with the first end of the first rod locked in the first side link by the lock assembly; in a case that the adjustable-length watch strap is in the second state, the lock assembly is unlocked, and the first end of the first rod is at least partially exposed from the first side link, such that two adjacent strap units can be separated by removing the first rod.

18. The adjustable-length watch strap according to claim 17, wherein the middle link comprises a first through hole and a second through hole, the first through hole and the second through hole are spaced apart and opposite to each other, the first side link comprises a first fitting hole and a first connecting hole penetrating through a lateral side of the first side link, the first side link is adjacent to the middle link, the second side link comprises a second fitting hole and a second connecting hole penetrating through a lateral side of the second side link, the second side link is adjacent to the middle link, the second connecting hole is aligned with the first through hole of the adjacent middle link and with the first fitting hole, and the first rod extends through the first fitting hole, the first through hole of the adjacent middle link, and the second connecting hole in sequence, the second fitting hole is aligned with the second through hole and with the first connecting hole, and the second rod extends through the second through hole, and two ends of the second rod are respectively and fixedly received in the second fitting hole and the first connecting hole.

19. The adjustable-length watch strap according to claim 17, wherein the lock assembly is movably arranged in the first side link and comprises a lock received in an receiving groove of the first side link and configured to lock the first end of the first rod in the case that the adjustable-length watch strap is in the first state; the lock is movable from an initial position to a pressed position in response to the lock being depressed by an external force; in the pressed position, the first end of the first rod is unlocked from the first side link, the first rod is detachable from the middle link, in response to the lock being release form the external force, the lock moves upward to return to a free position.

20. The adjustable-length watch strap according to claim 19, wherein the first end of the first rod defines a recess with an abutting surface on an end face facing the recess, an end wall of the lock faces the middle link and is configured to abut the abutting surface of the first rod in the case that the adjustable-length watch strap is in the first state.

* * * * *